US005501406A

United States Patent [19]

Henning

[11] Patent Number: 5,501,406

[45] Date of Patent: Mar. 26, 1996

[54] PLASTIC BOBBIN CARRIER

[76] Inventor: Walter Henning,
Hermann-Löns-Strasse 1, D-5110
Alsdorf-Hoengen, Germany

[21] Appl. No.: 133,134

[22] PCT Filed: Apr. 15, 1992

[86] PCT No.: PCT/DE92/00310

§ 371 Date: Dec. 22, 1993

§ 102(e) Date: Dec. 22, 1993

[87] PCT Pub. No.: WO92/18408

PCT Pub. Date: Oct. 29, 1992

[30] Foreign Application Priority Data

Apr. 20, 1991 [DE] Germany ..... 41 12 954.7

[51] Int. Cl.[6] ..... B65H 75/20; B65H 75/12; D06F 17/00

[52] U.S. Cl. ..... 242/118.11; 242/118.31; 68/198

[58] Field of Search ..... 242/118.1, 118.11, 242/118.2, 118.3, 118.31; 68/189, 198

[56] References Cited

U.S. PATENT DOCUMENTS

| | | | |
|---|---|---|---|
| 2,171,890 | 9/1939 | Precourt | 242/118.1 |
| 2,336,086 | 12/1943 | Goldman | 242/118.1 |
| 3,232,082 | 2/1966 | Fallscheer | 242/118.1 |
| 3,448,597 | 6/1969 | Livingstone | 68/198 |
| 3,532,291 | 10/1970 | Newman | 242/118.31 |
| 3,556,429 | 1/1971 | Steffenini | 242/118.31 |
| 3,563,491 | 2/1971 | Hahm et al. . | |
| 4,078,740 | 3/1978 | Hahm et al. . | |
| 4,181,274 | 1/1980 | Burchette, Jr. . | |
| 4,270,710 | 6/1981 | Ono . | |
| 4,349,165 | 9/1982 | Henning et al. . | |
| 4,379,529 | 4/1983 | Nielsen | 242/118.11 |
| 4,637,233 | 1/1987 | Tanaka et al. | 242/118.1 |
| 4,667,895 | 5/1987 | Becker et al. | 242/118.1 |
| 4,729,526 | 3/1988 | Becker et al. | 242/118.1 |
| 4,760,976 | 8/1988 | Burchette, Jr. | 242/118.11 |
| 5,178,342 | 1/1993 | Romagnoli | 242/118.1 |

FOREIGN PATENT DOCUMENTS

| | | | |
|---|---|---|---|
| 2355761 | 1/1978 | France | 242/118.11 |
| 1900500 | 7/1970 | Germany . | |
| 1635084 | 7/1971 | Germany . | |
| 2408949 | 9/1975 | Germany . | |
| 3049632 | 4/1986 | Germany . | |

*Primary Examiner*—Daniel P. Stodola
*Assistant Examiner*—Michael R. Mansen
*Attorney, Agent, or Firm*—Popham, Haik, Schnobrich & Kaufman, Ltd.

[57] ABSTRACT

A plastic bobbin carrier for taking up threads and yarns, with a cylindrical or conical shell provided with radial openings and with one end ring at each end of the shell, whereby this shell is comprised of several cylindrical or conical shell segments. These shell segments form a joint cylindrical or conical inner shell surface. Supporting webs join these shell segments together. These supporting webs run in a straight line or helicoidally from one end ring to the other, resting on the inner surfaces of the shell segments to which they are joined as one piece. The supporting webs may be rigid or ductile. When ductile supporting webs are employed, axial, radial, or axial and radial compressibility of the bobbin carrier in attainable.

16 Claims, 7 Drawing Sheets

PLASTIC BOBBIN CARRIER

BACKGROUND OF THE INVENTION

1. Field of the Invention

The invention concerns a plastic bobbin carrier for taking up threads and yarns, with a cylindrical or conical shell which is provided with radial openings and which forms a winding surface and with one end ring at each end of the shell, whereby the shell is comprised of several shell segments configured at a distance from one another, forming a cylindrical or conical inner shell surface, said segments being joined together by supporting webs.

2. Description of the Prior Art

A known bobbin carrier of this type (DE 24 08 949 A1) incorporates intermediate rings between two end rings, whereby these intermediate rings are positioned parallel to the end rings and are axially displaced from one another, and webs parallel to the axis are located between the intermediate rings for the purpose of connecting adjacent intermediate rings. The webs are provided with bending points which facilitate bending radially to the axis, thereby enabling axial shortening of the bobbin carrier.

In the case of this known bobbin carrier, the fact that sufficient space must remain between the rings for the webs after axial compression of the bobbin carrier results in a minimum permissible limit for the spacing between the rings. Several mould segments are required in the manufacture of this known bobbin carrier, and each of these segments is individually drawn in radial direction during removal from the mould. This inevitably results in all the webs produced from such a mould segment being unmoulded in the same direction of pull and their flanks being formed accordingly. As a result, the cross-sections of adjacent webs will differ, unless an economically inviable number of mould segments is employed. This bobbin carrier therefore possesses divergent webs over its circumference which may differ, for example, with regard to their flexural strength.

Furthermore, on this known bobbin carrier the webs which engage with a ring are displaced in relation to one another in the circumferential direction. When axial compression is applied, this results in deformation of the rings concerned, which may well be undesired.

A further bobbin carrier is known (DE-PS 1 635 084) which has proved to be generally effective in the wet treatment of threads and yarns, incorporating ring elements between the end rings on the faces of the bobbin carrier, with connecting webs running primarily in the axial direction between these ring elements. In conjunction with the ring elements, the connecting webs form a winding surface on which the inner layers of a lap of thread or yarn are supported. The inner windings of such laps thus rest both on the ring elements and on the outer edges of the connecting webs which protrude into the winding surface, whereby the individual ring elements are to be regarded as rigid elements.

In the case of this known bobbin carrier, the fact that the inner windings of the lap come into direct contact with the connecting webs, which deform and alter their distances from the adjacent ring elements during compression, may result in the inner windings of the yarn becoming caught between two sections of a connecting element, or between a connecting element and an adjacent ring element. In this way, the inner windings are occasionally destroyed and cannot be unwound in the correct manner. Furthermore, a multipart mould is required in the manufacture of this known bobbin carrier, in order to ensure the required radial extension of the cross-section of the carrying elements.

SUMMARY OF THE INVENTION

The present invention is based on the task of further developing a bobbin carrier of the type mentioned at the beginning of this description, in particular so as to simplify the method of manufacture and to reduce the required scope of complexity regarding the mould.

This objective is attained by a bobbin carrier of the type mentioned at the beginning of this description by virtue of the fact that the supporting webs are continuous webs running in a straight line or helicoidally from one end ring to the other, that these webs possess a cross-section which is constant over their entire length or diminishes in one direction, that they rest on the inner surfaces of the shell segments, to which they are joined as one piece, and that they protrude radially over the radially inwardmost surface of at least one end ring.

The mould for production of such a bobbin carrier requires only two outer mould parts and a core, whereby the latter can be produced as a one-piece core and can be drawn towards one end of the mould; for helicoidal supporting webs, rotation of the core is additionally necessary.

The shell segments can be provided with perforations in the established manner. The surfaces of the shell segments can additionally be provided with a toughened or corrugated finish.

The bobbin carrier in accordance with the present invention can further be configured in such a manner that the sections of the supporting webs located between two shell segments are ductile.

This configuration permits axial and/or radial compression of the bobbin carrier, enabling laps positioned one over the other along the axis to be pressed together, or a reduction in the circumference for shrinking yarn. This bobbin carrier is subsequently also suitable for the dyeing and thermal treatment of yarns.

The configuration of the supporting webs in accordance with the present invention eliminates the possibility of the webs coming into contact with the yarn. Consequently, buckling or bending of the supporting webs in the course of axial or radial compression can never lead to threads or yarns becoming caught on adjacent shell segments.

The bobbin carrier in accordance with the present invention can further be configured in such a manner that the spaces between the shell segments are partially closed by a film covering in the area of the inner surface of the shell. This film covering enables the area of the openings, which is otherwise determined primarily by the distances between the shell segments, to be reduced to the desired size, whereby the size of the opening left by the film covering may vary over the height of the bobbin carrier.

The bobbin carrier in accordance with the present invention can further be configured in such a manner that the film covering is contoured on its radially outward-facing side and incorporates zones of reduced flexural strength. In this way it can be ensured that the film covering always bends radially inwards and never outwards during compression.

The bobbin carrier in accordance with the present invention can further be configured in such a manner that the shell segments are parallel rings, the axes of which coincide with the longitudinal axis of the bobbin carrier. The shell surface bearing the yarn lap is then determined solely by the rings which move towards one another under axial compression, but which cannot come into direct contact with one another on account of the supporting webs provided on the inside.

The bobbin carrier in accordance with the present invention can further be configured in such a manner that the shell segments are constituted by the windings of at least one supporting web running spirally from one end ring to the other.

The bobbin carrier in accordance with the present invention can further be configured in such a manner that the shell segments are bearing units which are located at a distance from one another in the circumferential direction and which mesh together, leaving a gap in the circumferential direction, whereby the supporting webs are located on the inner surfaces of the bearing units, in the area of the meshing parts of the bearing units. In this manner, the carrier in accordance with the present invention can also be configured in such a manner that it is radially compressible, thereby enabling it to adapt to the shrinkage of the spooled yarn which is likely to occur in particular when the yarn is subjected to thermal treatment.

The bobbin carrier in accordance with the present invention can further be configured in such a manner that it is compressible in the axial direction only, in the radial direction only, or in the axial and radial directions. For each type of compression, cams can be provided in addition to the supporting webs, to ensure that the desired distance is maintained between adjacent shell segments.

The bobbin carrier in accordance with the present invention can further be configured in such a manner that each supporting element runs continuously from one end ring to the other, whereby these supporting elements can be provided with perforations. This will be necessary in particular when only a small number of supporting elements are used, which will subsequently possess a relatively high degree of circumferential extension.

The bobbin carrier in accordance with the present invention can further be configured in such a manner that the supporting elements are divided in the axial direction into several spaced sub-elements which are connected by supporting webs. Such a bobbin carrier is compressible in both the axial and radial directions.

The bobbin carrier in accordance with the present invention can further be configured in such a manner that the shell segments incorporate recesses on their mutually facing edges in the area in which a supporting web passes through. In this way, the length of the ductile supporting webs between two adjacent shell segments can be increased. This may be expedient, in order to attain the desired compression in conjunction with the required cross-sectional dimensions for the supporting webs.

The bobbin carrier in accordance with the present invention can further be configured in such a manner that the spacing between the shell segments increases and/or decreases as the distance from an end ring increases. This can help to even out the cross-section of the opening for a dye bath or similar.

BRIEF DESCRIPTION OF THE DRAWINGS

Some embodiments of the bobbin carrier in accordance with the present invention are described below with reference to drawings.

DESCRIPTION OF THE PREFERRED EMBODIMENT(S)

Figure 1:
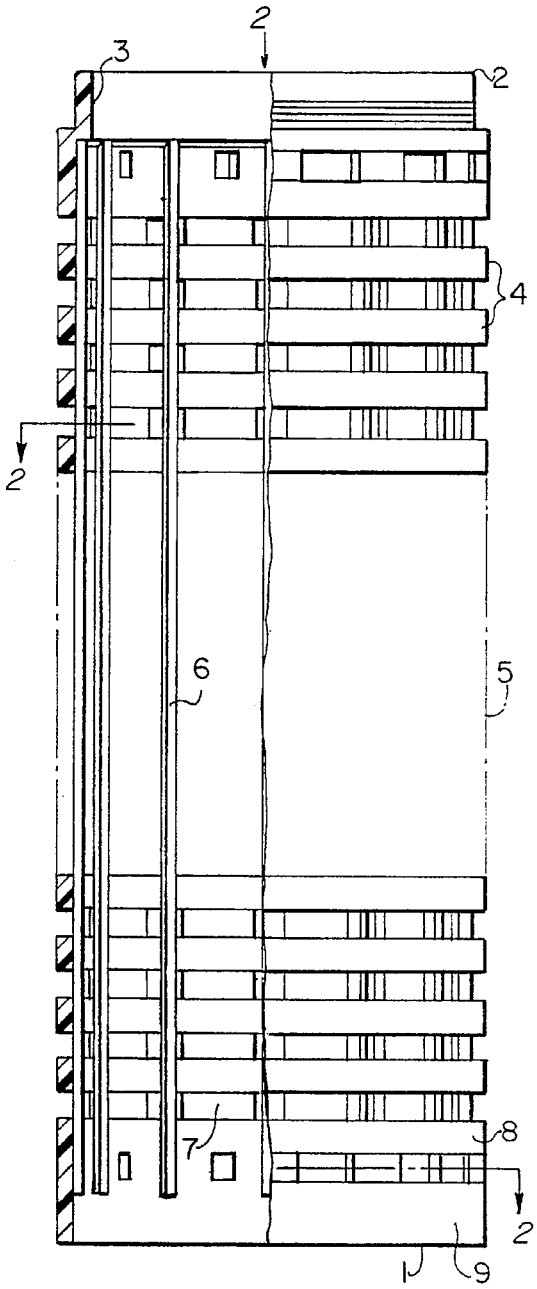
FIG. 1 shows an initial embodiment of the bobbin carrier in accordance with the present invention, whereby the shell segments take the form of rings; an axial section is shown on the left and a side view on the right.
Figure 3:
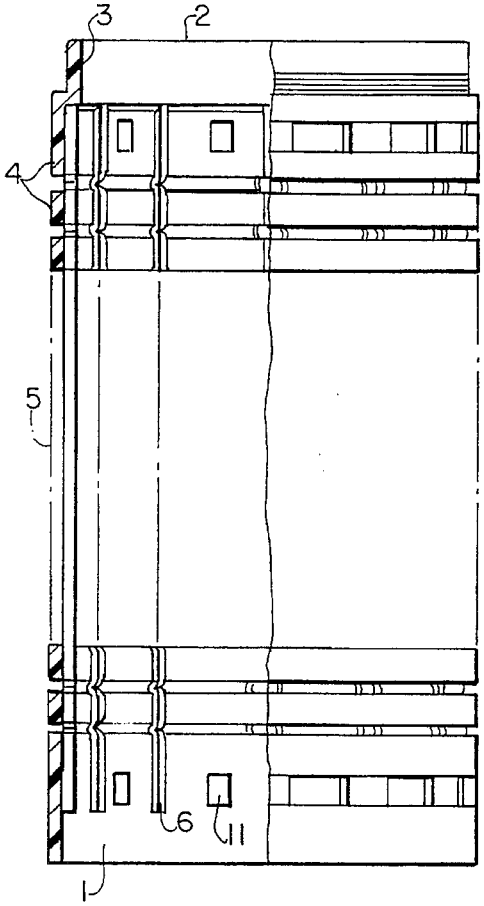
FIG. 3 shows the carrier in accordance with FIG. 1 in an axially compressed state.
Figure 2:
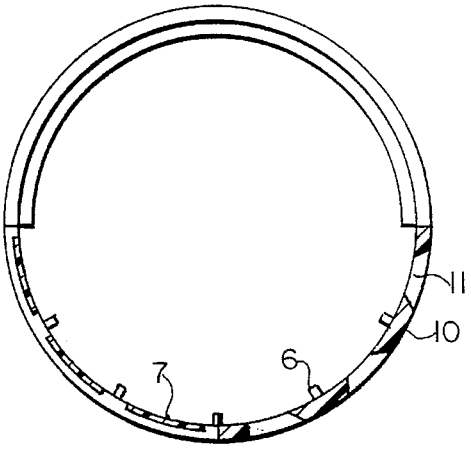
FIG. 2 shows a view in the direction of arrow 2 in FIG. 1 in the top half, and a section along the line 2—2 in FIG. 1 in the bottom half.

The bobbin carrier in accordance with the embodiment shown in FIGS. 1 to 3 has one lower end ring, 1, and one upper end ring, 2. The upper end ring is provided with an axially protruding collar, 3, of reduced external diameter. The collar, 3, of this bobbin carrier fits into the lower end ring, 1, of an identical bobbin carrier which is placed over the collar. Between end rings 1 and 2, co-axial shell segments running parallel to the end rings are provided in the form of rings, 4, whereby each ring, 4, is positioned at a distance from its adjacent ring and/or the adjacent end ring, 1, 2. The distances between these rings may vary over the height of the bobbin carrier.

In this embodiment, the end rings, 1, 2, and the rings, 4, form a cylindrical winding surface, 5. The inner surfaces of the end rings, 1, 2 and 4, form a joint cylindrical inner shell surface, above which only the collar, 3, protrudes radially inwards.

Figure 10:
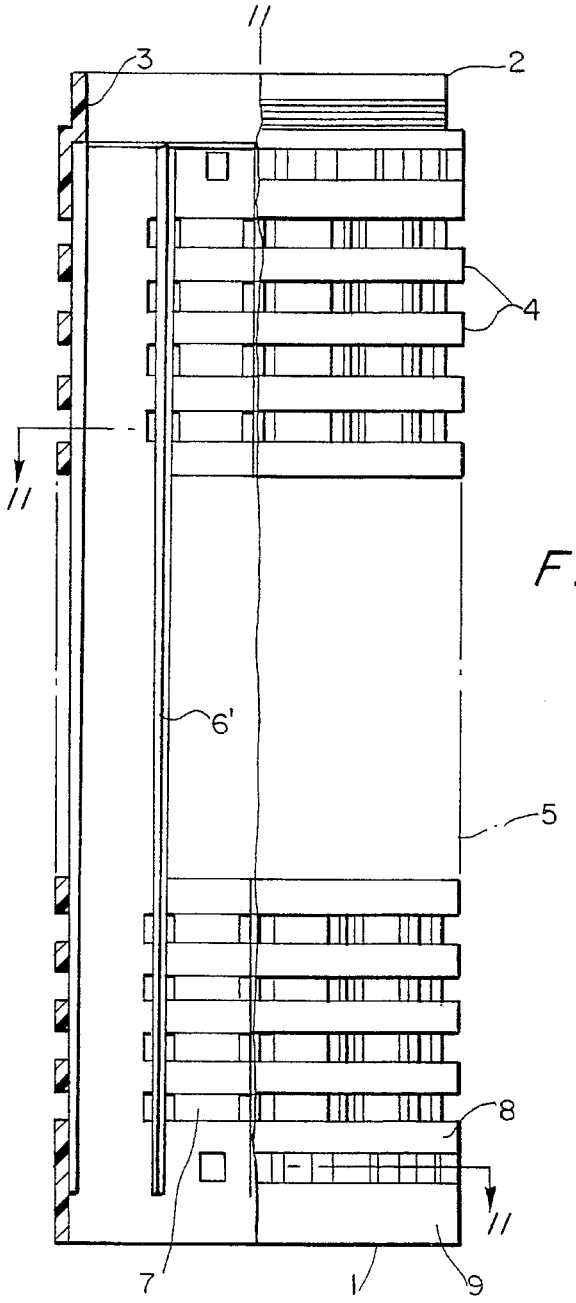
FIG. 10 shows another embodiment of the bobbin carrier in accordance with the present invention, similar to FIG. 1, but wherein the webs have a cross-section of circumferentially diminishing cross-section from top to bottom.
Figure 11:
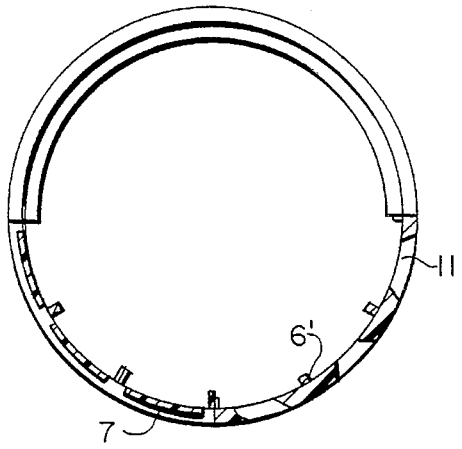
FIG. 11 shows a view in the direction of arrow 11 in FIG. 10 in the top half, and a section along line 11—11 in the bottom half.
Figure 12:
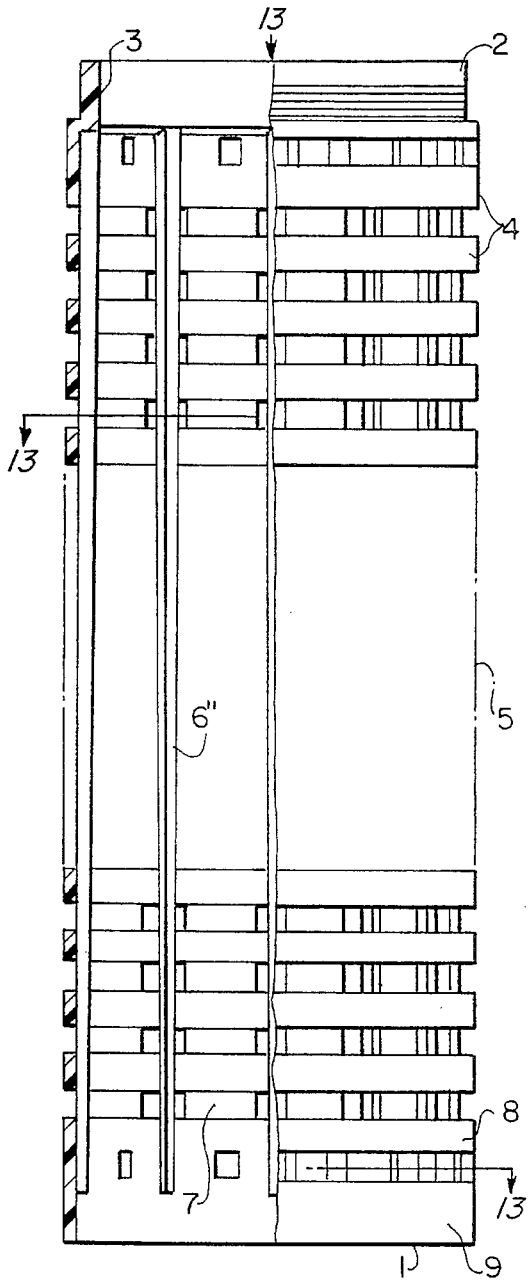
FIG. 12 shows still another embodiment of the bobbin carrier in accordance with the present invention, similar to FIG. 1, but wherein the webs have a cross-section of both circumferentially and radially diminishing cross-section from top to bottom.
Figure 13:
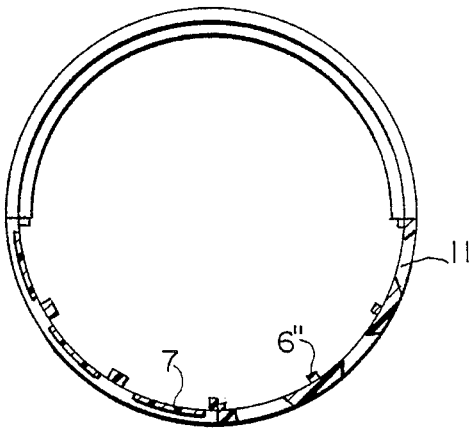
FIG. 13 shows a view in the direction of arrow 13 in FIG. 12 in the top half, and a section along line 13—13 in the bottom half.
Figure 14:
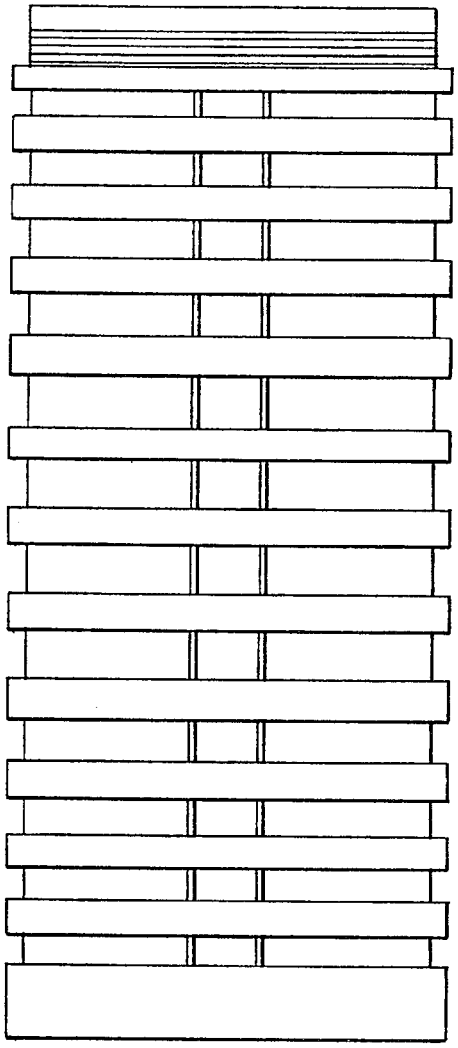
FIG. 14 shows another embodiment of the bobbin carrier in accordance with the present invention, similar to FIG. 1, but wherein the spacing between the shell segments increases as the distance from both the first and second end rings increases.
Figure 15:
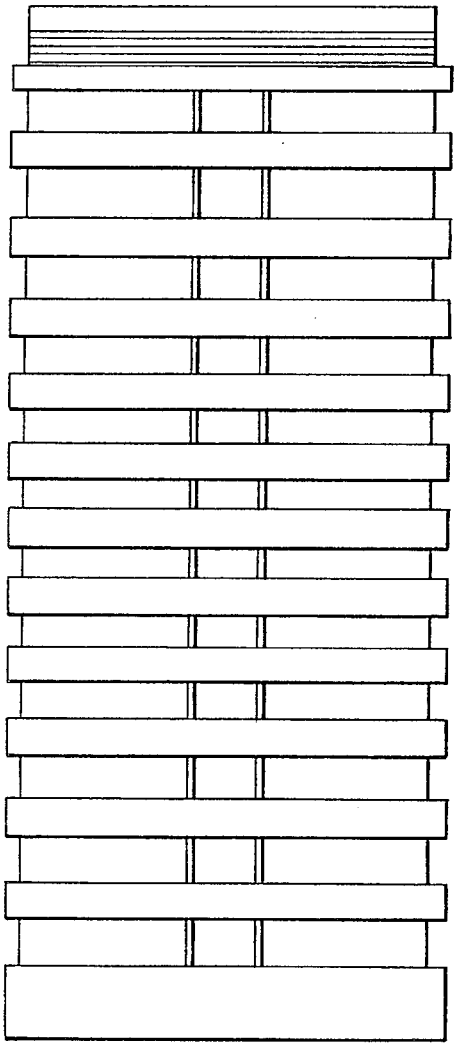
FIG. 15 shows still another embodiment of the bobbin carrier in accordance with the present invention, similar to FIG. 1, but wherein the spacing between the shell segments decreases as the distance from both the first and second end rings increases.
Figure 16:
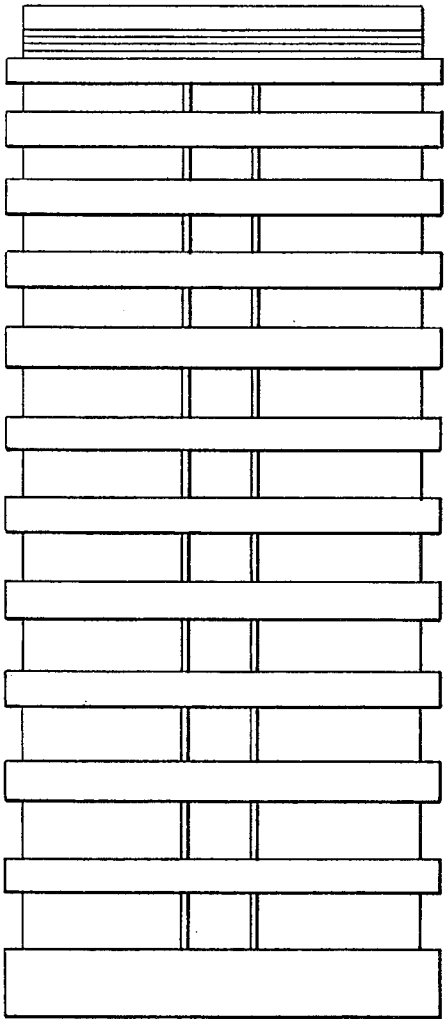
FIG. 16 shows another embodiment of the bobbin carrier in accordance with the present invention, similar to FIG. 1, but wherein the spacing between the shell segments increases as the distance from the first end rings increases.
Figure 17:
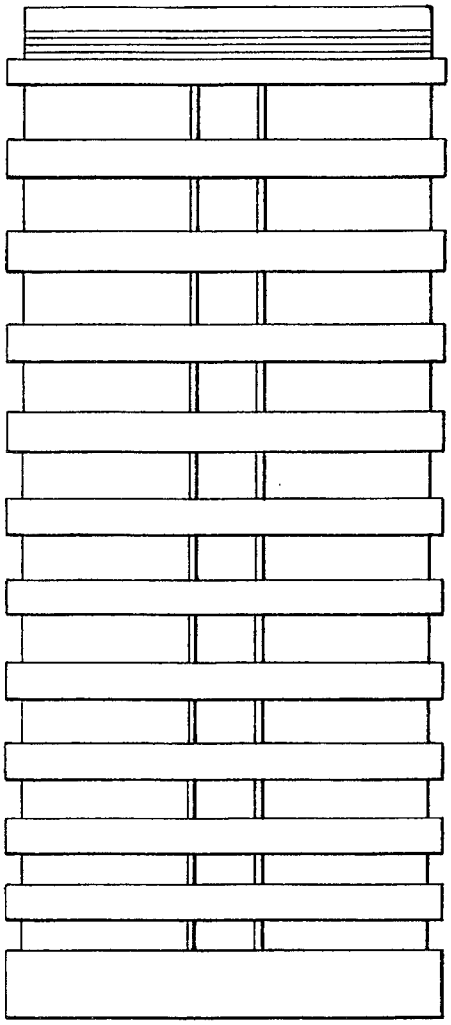
FIG. 17 shows another embodiment of the bobbin carrier in accordance with the present invention, similar to FIG. 1, but wherein the spacing between the shell segments decreases as the distance from the first end ring increases.

Supporting webs, 6, are provided which run in a straight line from the upper end ring, 2, at the point of connection with the collar, 3, to the lower end ring, 1, and these webs, 6, are fixed to the inner surfaces of the rings. The supporting webs, 6, possess the same cross-section along their entire length. A reduction in the cross-section in the direction of the lower end ring, 1, would also be possible, however, as shown with respect to webs 6' in FIGS. 10 and 11 and webs 6" in FIGS. 12 and 13.

The annular gaps between the lower end ring, 1, and the adjacent ring, 4, between adjacent rings, 4, and between the uppermost ring, 4, and the upper end ring, 2, are partially covered by a film covering, 7. The extent of this covering determines the opening of the bobbin carrier, which may be required for a dye bath, for example.

Figure 9:
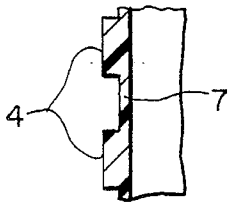
FIG. 9 shows a detailed cross-section through two rings positioned one above the other and a connecting film covering contoured on its outer side.

As shown in FIG. 9, the film covering, 7, can be contoured in such a manner that it is thinnest in the middle of the annular gap. In this way, a folding point is created for the film covering, 7, which causes the film covering, 7, to fold radially inwards when the bobbin carrier is subjected to axial compression. In the embodiment shown, the film covering, 7, is contoured on its outer surface.

The lower end ring, 1, is comprised of two sub-rings, 8, 9, which are joined together by means of rigid support webs, 10, which leave openings, 11, between the two sub-rings.

Figure 7:
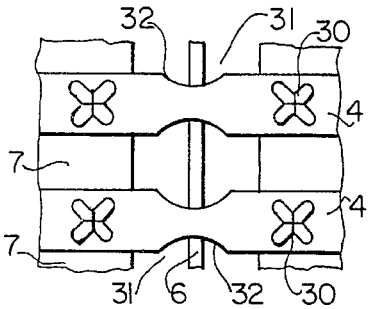
FIG. 7 shows a detailed view of two adjacent rings and one connecting supporting web.
Figure 7A:
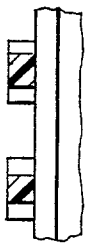
FIG. 7A is a cross-sectional view taken along line 7A—7A of FIG. 7.

FIGS. 7 and 7A show two adjacent rings, 4, to which cross-shaped elevations or recesses, 30, have been applied, which are intended to secure the yarn on the winding surface. The space between the two rings, 4, is partially closed by a film covering, 7, leaving openings, 31.

The rings, 4, are provided with recesses, 32, in the area in which the rings, 4, are connected to the supporting web, 6. These recesses between adjacent rings, 4, increase the ductile span of the supporting web, 6. They thus improve the ductility.

Figure 8:
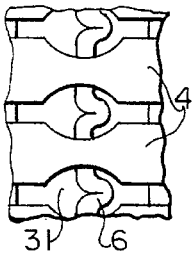
FIG. 8 shows a detailed view in accordance with FIG. 7 in an axially compressed state.
Figure 8A:
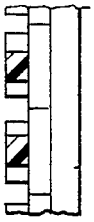
FIG. 8A is a cross-sectional view taken along line 8A—8A of FIG. 8.

FIGS. 8 and 8A show the main features of the view in accordance with FIGS. 7 and 7A after axial compression, whereby the deformed supporting web, 6, determines the axial compressibility of the bobbin carrier.

In the above-described embodiment and all the embodiments described below, the bobbin carrier in accordance with the present invention is moulded as a single piece in plastic.

The injection mould for this bobbin carrier is provided by a core (not shown) which can be drawn out of the lower end ring, 1. Only two mould halves are required for the outer mould.

Figure 4:
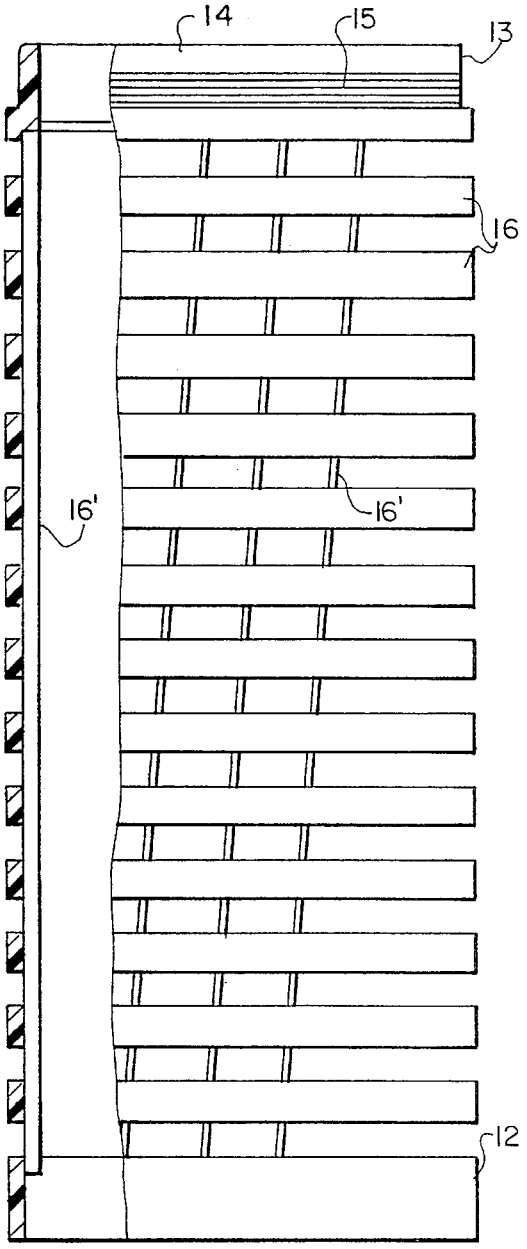
FIG. 4 shows a bobbin carrier similar to that shown in FIGS. 1 to 3 with spiral supporting webs.

FIG. 4 shows a further embodiment of the bobbin carrier in accordance with the present invention, incorporating a lower end ring, 12, and an upper end ring, 13, whereby the latter has an axially protruding collar, 14, of reduced external diameter, incorporating a reserve thread groove, 15. Here again, spaced rings, 16, are provided between the two end rings, 12, 13, as described with regard to the embodiment shown in FIGS. 1 to 3. Supporting webs, 16', are provided which extend helicoidally from the upper end ring, 13, at the joint with the collar, 14, to the lower end ring, 12.

The core required in the manufacture of this bobbin carrier can be drawn out of the lower end ring, 12, whereby a rotary movement corresponding to the helicoidal form of the supporting webs, 16', is to be superimposed over the straight drawing movement. Two mould halves are required for the outer mould, as described above.

Figure 5:
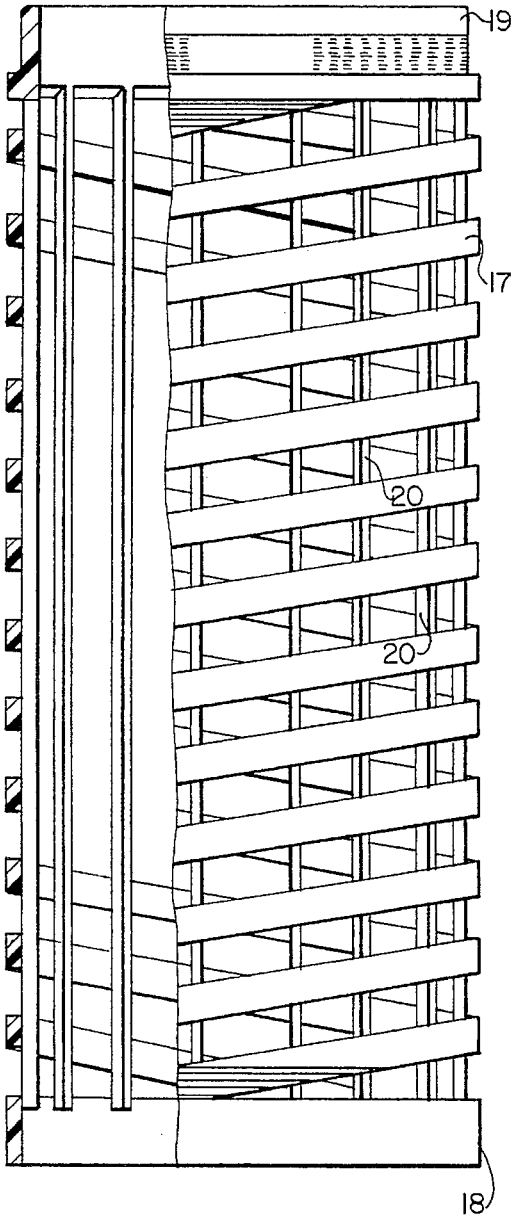
FIG. 5 shows a further embodiment of the bobbin carrier in accordance with the present invention, whereby the shell segments are formed by the windings of spiral supporting elements.

The embodiment of the inventive bobbin carrier in accordance with FIG. 5 differs from that shown in FIGS. 1 to 3 only in that the shell segments are formed by the windings, 17, of two supporting elements extending spirally between a lower end ring, 18, and an upper end ring, 19. Supporting webs, 20, are provided which extend in the above-described manner between the end rings, 18, 19, and are fixed to the inner surfaces of the windings, 17.

Figure 6:
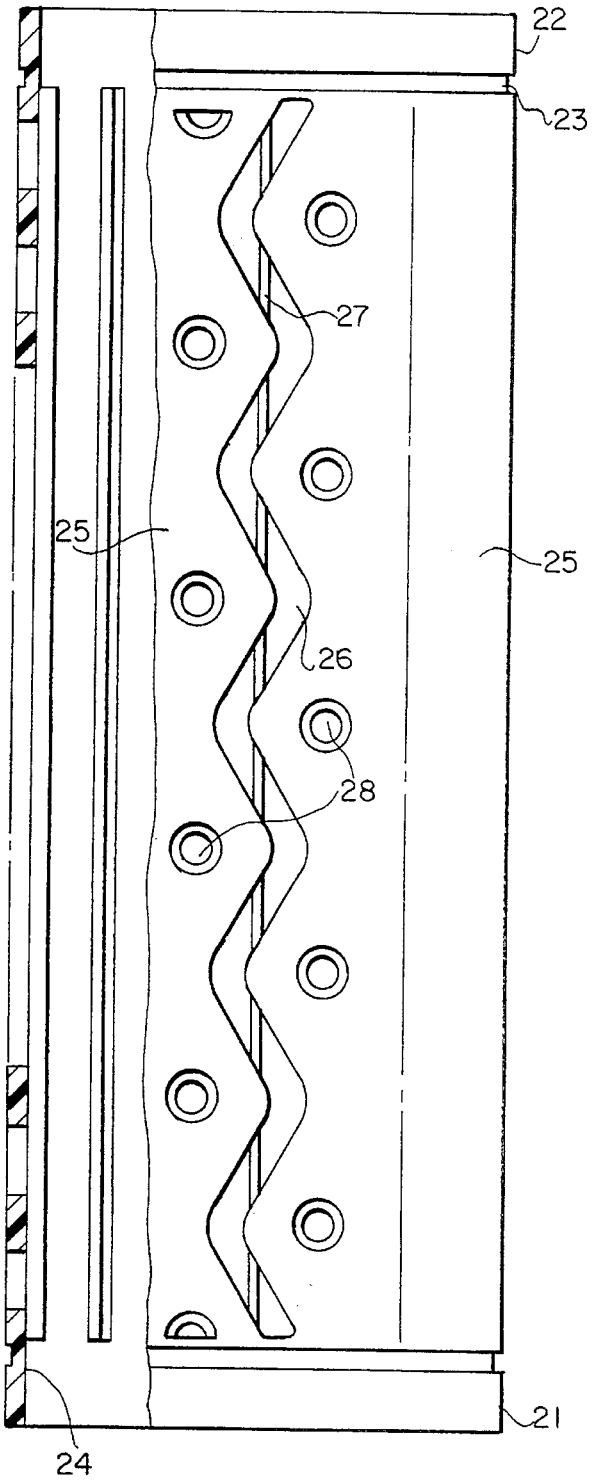
FIG. 6 shows a radially compressible embodiment of the bobbin carrier in accordance with the present invention, whereby the shell segments take the form of a shell running from one end ring to the other.

The embodiment of the bobbin carrier in accordance with the present invention shown in FIG. 6 has a lower end ring, 21 and an upper end ring, 22. The upper end ring, 22, incorporates a reserve thread groove, 23. All the inner surfaces of the end rings, 21, 22 rest against a common cylindrical inner surface, 24. Continuous, perforated, shell-type support elements, 25, extend between the end rings, 21, 22. The inner surfaces of these support elements, 25, rest against the cylindrical inner surface, 24. Correspondingly, the outer surfaces of the support elements, 25, and the outer surfaces of the end rings, 21, 22, also lie on a common cylindrical surface and form a winding surface.

There is a zig-zag gap, 26, between each two circumferentially adjacent support elements, 25, located between the end rings, 21, 22. The edges of the support elements, 25, adjoining this gap, 26, on either side thus interlock in zig-zag form. One supporting web, 27, running in a straight line from the upper end ring, 22, to the lower end ring, 21, is assigned to each gap, 26, and passes through the longitudinal center of the zig-zag form of the gap, 26, whereby in the axial direction it is fixed alternately to the inner surface of one and then the other support element, 25.

This embodiment of the bobbin carrier enables the width of the gap, 26, to be reduced, as a result of which it is possible to reduce the circumference of the winding surface of the bobbin carrier. In this way, due account can be taken of yarn shrinkage.

The support elements, 25, can be divided into spaced sub-elements in the axial direction, whereby the gaps between the sub-elements can be connected by additional supporting webs.

The support elements, 25, are provided with openings, 28.

In the case of all the above-described embodiments, the supporting webs extend continuously with a constant or diminishing cross-section from one end ring to the other, whereby the cross-section of the supporting web protrudes fully radially inwards over the inner surface of this other end ring. The supporting webs rest against a cylindrical or conically expanding surface which is formed by the inner surfaces of the shell segments and end rings.

The bobbin carrier in accordance with the present invention can be provided with diverse designs of end rings. These end rings can be configured in such a manner that the end rings of adjacent bobbin carriers axially interlock or, as applies in the case of the embodiment shown in FIG. 6, buffet against one another.

In particular, the outer surfaces of the end rings can form a continuous cylindrical or conical winding surface with the other shell segments. It is also possible to provide an end ring with a radially protruding collar.

The supporting webs can be configured in rigid design, thereby permanently fixing the distance between adjacent shell segments. It is more expedient, however, to design the supporting webs in such a manner that they deform in the area of the gap between the shell segments when the bobbin carrier is subjected to axial pressure, resulting in a shortening of the bobbin carrier. In this connection, reference is made to the embodiments in accordance with FIGS. 1 to 5.

Equally, rigid or circumferentially ductile supporting webs, 27, in accordance with the embodiment shown in FIG. 6 can be employed, to enable adaption to radial shrinkage.

I claim:

1. A one-piece plastic bobbin carrier for taking up threads and yarns, said plastic bobbin carrier being in the form of a substantially cylindrical shell having radial openings therein and first and second ends, said shell comprising:

first and second end rings at said first and second ends of said shell, said first and second end rings having radially inwardmost surfaces;

an outer winding surface;

a substantially cylindrical inner surface;

a plurality of shell segments spaced apart from one another, said shell segments having inner and outer surfaces, said outer surfaces defining said outer winding surface of said shell, and said inner surfaces defining said inner surface of said shell;

a plurality of supporting webs joining said shell segments together, said supporting webs being continuous and extending from said first end ring to said second end ring, said supporting webs having a cross section which is constant over their entire length, said supporting webs resting on said inner surface of said shell segments and being formed in one piece with said shell segments, and said supporting webs protruding radially over said radially inwardmost surface of at least one of said first and second end rings.

2. The bobbin carrier of claim 1, wherein said webs extend axially in a straight line between said first and second end rings.

3. The bobbin carrier of claim 1, wherein said webs extend helicoidally between said first and second end rings.

4. The bobbin carrier of claim 1, wherein sections of said supporting webs located between adjacent shell segments are ductile.

5. The bobbin carrier of claim 1, further comprising a film covering on said inner surface of said shell, said film covering partially closing the spaces between said shell segments.

6. The bobbin carrier of claim 5, wherein said film covering has a contoured, radially outwardly facing side and incorporates zones of reduced flexural strength.

7. The bobbin carrier of claim 1, wherein said bobbin carrier has a longitudinal axis, and wherein said shell segments are parallel rings coaxial with said longitudinal axis of said bobbin carrier.

8. The bobbin carrier of claim 1, wherein said shell segments comprise bearing units spaced circumferentially from one another, said shell segments having opposed side edges and inner and outer surfaces, adjacent side edges of adjacent shell segments being circumferentially spaced from one another and having complementary alternating indentations and protrusions, and said supporting webs being located on said inner surfaces of said shell segments at said side edges.

9. The bobbin carrier of claim 8, wherein said bearing units extend continuously between said first and second end rings.

10. The bobbin carrier of claim 8, wherein said bearing units comprise a plurality of spaced axial sub-elements and a plurality of additional supporting webs connecting said sub-elements.

11. The bobbin carrier of claim 1, wherein each said shell segment has opposed side edges, and said opposed side edges have facing recesses formed therein in the area where said supporting web rests on said inner surface of said shell segment.

12. The bobbin carrier of claim 1, wherein the spacing between said shell segments increases as the distance from one of said first and second end rings increases.

13. The bobbin carrier of claim 1, wherein the spacing between said shell segments increases as the distance from one of said first and second end rings decreases.

14. A one-piece plastic bobbin carrier for taking up threads and yarns, said plastic bobbin carrier being in the form of a substantially cylindrical shell having radial openings therein and first and second ends, said shell comprising:

first and second end rings at said first and second ends of said shell, said first and second end rings having radially inwardmost surfaces;

an outer winding surface;

a substantially cylindrical inner surface;

a plurality of shell segments spaced apart from one another, said shell segments having inner and outer surfaces, said outer surfaces defining said outer winding surface of said shell, and said inner surfaces defining said inner surface of said shell;

a plurality of supporting webs joining said shell segments together, said supporting webs being continuous and extending from said first end ring to said second end ring, said supporting webs having a cross section which diminishes in one direction over their length, said supporting webs resting on said inner surface of said shell segments and being formed in one piece with said shell segments, and said supporting webs protruding radially over said radially inwardmost surface of at least one of said first and second end rings.

15. A one-piece plastic bobbin carrier for taking up threads and yarns, said plastic bobbin carrier being in the form of a substantially cylindrical shell having radial openings therein and first and second ends, said shell comprising:

first and second end rings at said first and second ends of said shell, said first and second end rings having radially inwardmost surfaces;

an outer winding surface;

a substantially cylindrical inner surface;

a plurality of shell segments spaced apart from one another, said shell segments having inner and outer surfaces, said outer surfaces defining said outer winding surface of said shell, and said inner surfaces defining said inner surface of said shell;

a plurality of supporting webs joining said shell segments together, said supporting webs being continuous and extending from said first end ring to said second end ring, said supporting webs extending helicoidally between said first and second end rings and having a cross section which diminishes in one direction over their length, said supporting webs resting on said inner surface of said shell segments and being formed in one piece with said shell segments, and said supporting webs protruding radially over said radially inwardmost surface of at least one of said first and second end rings.

16. A one-piece plastic bobbin carrier for taking up threads and yarns, said plastic bobbin carrier being in the form of a substantially cylindrical shell having radial openings therein and first and second ends, said shell comprising:

first and second end rings at said first and second ends of said shell, said first and second end rings having radially inwardmost surfaces;

an outer winding surface;

a substantially cylindrical inner surface;

a shell segment in the form of a winding extending spirally between said first and second end rings, said winding having a plurality of turns spaced apart from one another, said turns of said shell segment having inner and outer surfaces, said outer surfaces defining said outer winding surface of said shell, and said inner surfaces defining said inner surface of said shell;

a plurality of supporting webs joining said turns of said shell segment together, said supporting webs being continuous and extending from said first end ring to said second end ring, said supporting webs having a cross section which is constant over their entire length, said supporting webs resting on said inner surface of said turns of said shell segment and being formed in one piece with said shell segment, and said supporting webs protruding radially over said radially inwardmost surface of at least one of said first and second end rings.

* * * * *